US006427415B1

(12) United States Patent
Rosenkranz

(10) Patent No.: US 6,427,415 B1
(45) Date of Patent: Aug. 6, 2002

(54) CASEMENT FRAME FOR A WINDOW

(76) Inventor: Erich Rosenkranz, Binsengasse 10, D-97980 Bad Mergentheim (DE)

( * ) Notice: Subject to any disclaimer, the term of this patent is extended or adjusted under 35 U.S.C. 154(b) by 0 days.

(21) Appl. No.: 09/192,906

(22) Filed: Nov. 16, 1998

Related U.S. Application Data

(63) Continuation-in-part of application No. 08/645,315, filed on May 13, 1996, now abandoned.

(30) Foreign Application Priority Data

May 11, 1995 (DE) ..... 195 17 212

(51) Int. Cl.[7] ..... E06B 1/28; E06B 3/22
(52) U.S. Cl. ..... 52/656.5; 52/656.7
(58) Field of Search ..... 52/656.5, 656.2, 52/656.7, 656.6, 656.3

(56) References Cited

U.S. PATENT DOCUMENTS 4,640,078 A * 2/1987 Haffer ..... 52/656.5
4,977,722 A * 12/1990 Taylor ..... 52/656.2

FOREIGN PATENT DOCUMENTS

DE 3313661 * 10/1984 ..... 52/656.5
FR 2693761 8/1996

* cited by examiner

*Primary Examiner*—Michael Safavi
(74) *Attorney, Agent, or Firm*—Ostrolenk, Faber, Gerb & Soffen, LLP

(57) ABSTRACT

A casement frame for a window formed of a plastic section having a seat region for receiving an edge region of a window pane and a room-side casement region, and at least one heat conducting insert arranged in the plastic section and forming a thermal bridge between the casement and seat regions of the plastic section for conducting room heat to the edge region of the window pane. The plastic section is formed with chambers arranged along its cross section. The heat conducting insert being located in an innermost, or room adjacent, chamber with the heat transfer taking place inside the innermost chamber and the remaining chambers serving as heat insulating chambers.

14 Claims, 3 Drawing Sheets

CASEMENT FRAME FOR A WINDOW

RELATED APPLICATIONS

This application is a continuation-in-part of application Ser. No. 08/645,315 filed May 13, 1996 now abandoned.

BACKGROUND OF THE INVENTION

The present invention relates to a casement frame for a window, a door or the like and, in particular, for a skylight of a building, which casement frame is formed of a plastic hollow section having a seat region for receiving the edge of the window pane and a casement region, and includes at least one thermo-conductive insert arranged within the plastic hollow section.

Such casement frames are well known. Thus, a casement frame formed of a plastic hollow section is disclosed in an Austrian Patent No. 220,795. To prevent curving or warping of the plastic section when it is subjected to heat radiation, e.g., when it is irradiated with sun rays, the frame is provided with an insert, which is formed of a thermo-conductive material and is located adjacent to the outer surface of the frame and provides for uniform heat distribution. The uniform heat distribution prevents the piling up or accumulation of material only in certain regions of the plastic section and, as a result, all parts of the plastic section are cooled uniformly, preventing shifting of the section material.

German publication No. 1,908,117 discloses a plastic hollow section for forming a frame of a window or a door and in which the undesirable deformations, which occurs because of the poor thermal conductivity of the plastic material, are prevented by using a metal member connected with the plastic material in such a way that the heat is uniformly by distributed over all of the surfaces of the plastic section which prevents deformation resulting from non-uniform heating of the section.

It is also know to use metal elements for reinforcing of the plastic hollow sections from which window frames are formed. These metal elements or sections are arranged inside of the plastic sections so that a heat insulation gap (air gap) is formed between the metal and the plastic sections. The gap should prevent heat transfer from the plastic material to the reinforcing section so that the heat insulation of the window does not worsens.

Besides the danger of deformation of plastic hollow sections from which the frames of windows or doors are formed, there exists a danger, in particular when the plastic hollow sections are used for forming of casement frames for building skylights, of precipitation of the moisture, which is contained in the room air, on surfaces of the window which are cooled more than other surfaces so that condensate is deposited on these cooler surfaces. The condensate precipitation is sometimes so large that the water drips on a room floor, so that not only the visibility through the window is reduced, but an actual damage can occur.

Accordingly, an object of the present invention is to provide a casement frame formed of a hollow plastic section in which moisture precipitation on the inner side, i.e., on the room-facing side of the casement frame is prevented.

SUMMARY OF THE INVENTION

This and other objects of the invention, which will become apparent hereinafter, are achieved by arranging the heat conducting insert in the plastic section so that it formes a thermal bridge between the casement and seat regions of the plastic section for conducting heat from the casement region, which is exposed to the room temperature, to the seat region where the heat is transferred to the glass pane. The transferring of the heat from the casement region does not involve uniform distribution of heat and, therefore, does not adversely affect the heat insulation of the window. The present invention insures that the courses of isotherms, i.e. curves of the same temperatures, does not pass through the room-facing or room-side inner surface of the plastic section or the room itself. The present invention insures that the courses of the isotherms pass through the interior of the plastic section and pass into the window pane somewhere in the seat region. This means that no dew point temperatures occur in the edge region of the window pane, and no resulting moisture precipitation because of the condensation of the moisture, which is contained in the room air, takes place. Thereby, the drawback associated with the moisture precipitation are eliminated. In other words, the heat, which is generated due to the difference between the room temperature and the outside temperature, is absorbed by a predetermined area of the casement region of the plastic section and is conducted to the edge region of the window pane which is heated thereby. This prevents the condensation of the room air moisture on the window pane. The heat transfer through the thermal bridge, which is formed by the insert, is localized, so that the heat insulation of the window is substantially unaffected, an no substantial heat losses occur.

According to the preferred embodiment of the invention, the insert is made of metal. This insures obtaining of good heat conducting characteristics. The insert is formed as a shaped member, i.e., it has a predetermined shaped cross-section.

Advantageously, the plastic hollow section is formed with a plurality of chambers arranged along its cross-section. The insert is preferably located in the innermost chamber, i.e., the room-adjacent chamber of the plastic section. The heat transfer takes place inside this chamber, so that other chambers can perform different functions, e.g., they may serve as heat-insulating chambers.

The insert receiving chamber is so formed, with respect to the other chambers, that the heat transfer takes place only in a predetermined limited region defined by the circumference of the edge region of the window pane.

Advantageously, the insert receiving chamber adjoins another chamber which is located inward of the insert receiving chamber and which serves as a heat shielding chamber.

Preferably, the insert engages, at least in some areas, the room-side wall of the plastic section, with a preload, whereby good transfer of the room heat to the insert is insured.

The heat transfer characteristics are substantially improved when the insert follows the profile of the plastic section at least in some areas so that a large abutting surface is available. It should be pointed out that the area of heat transfer should be so selected that the heat insulation of the window remains substantially unaffected.

According to the present invention, the thermal bridge forming insert serves simultaneously as an reinforcing member, performing thus a double function.

To provide for good heat transfer, it is contemplated that the insert has a large surface area in the casement region of the plastic section and/or in the seat region of the plastic section, which insures a large contact area.

According to a further embodiment of the invention, the insert is connected to the room-side wall of the plastic section and/or the wall of the seat region of the plastic section with connection elements. Such a connection insures a clearance free contact and thereby good heat transfer characteristics.

As a connection elements preferably sheet metal screws are used. The screws not only improve the heat transfer but serve themselves as auxiliary thermal bridges.

Preferably, a sealing is provided between the seat region of the plastic section and the edge region of the window pane, which sealing is preferably formed as flat packing in order, on one hand, not to adversely affect the heat transfer from the insert to the edge region of the window pane and, on the other hand, to reliably insulate the window pane from the plastic section.

The connection elements or screws are arranged below the sealing in a spaced relationship with respect to each other along the connection area. Thereby, the heat is transferred, at least partially, into the sealing.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1A:
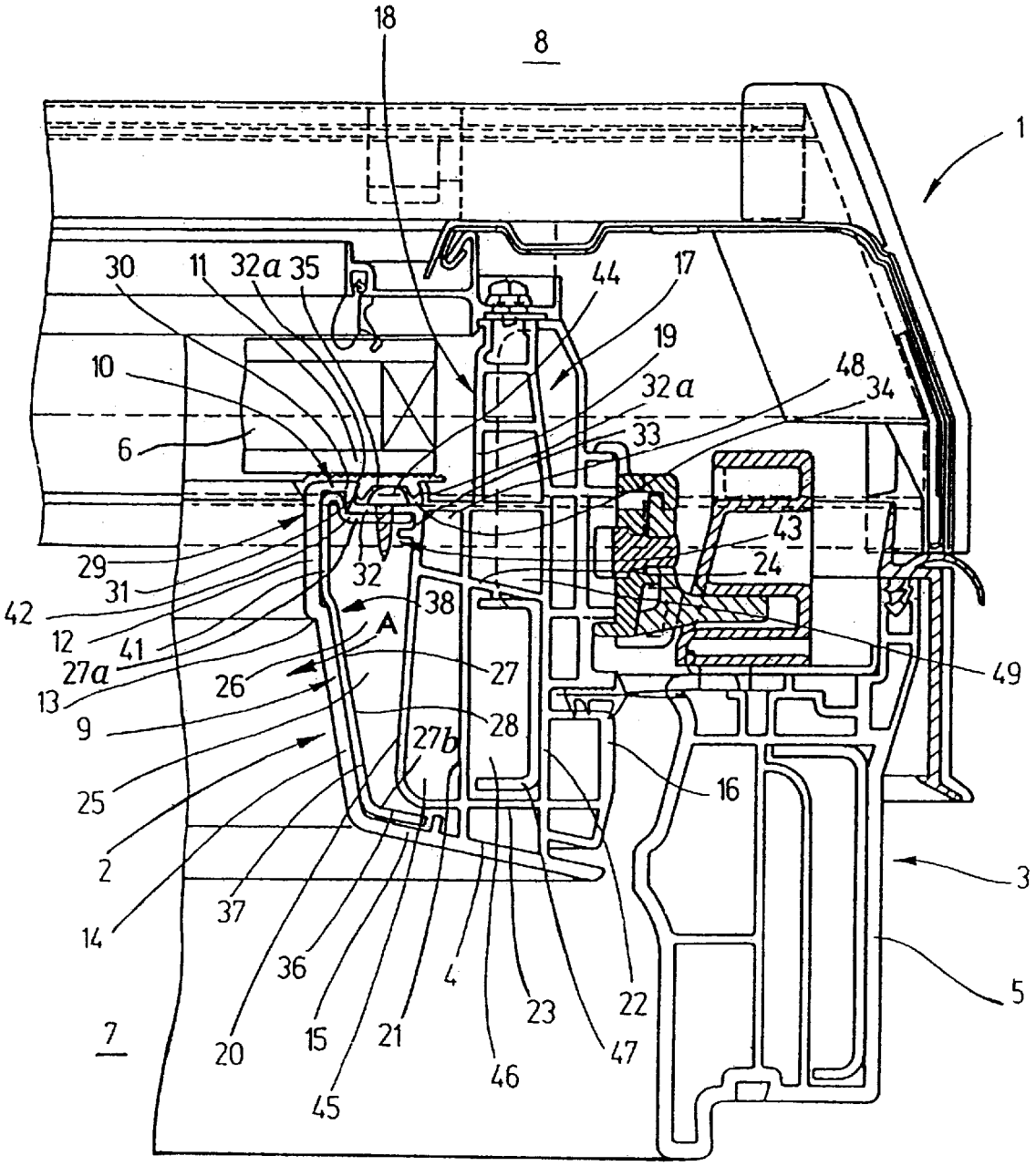
FIG. 1*a* is a cross-sectional view of a house skylight with a casement frame according to the present invention.

FIG. 1 shows a cross-sectional view of a house skylight 1 including a pivotal casement frame 2 and a stationary window frame 3. Both the casement frame 2 and the window frame 3 are formed of plastic hollow sections 4 and 5, respectively. The casement frame 2 has a pane 6 which is formed as a twin glass pane.

The plastic section 4 overlooks a room 7 of a building or the like having a skylight 1. The outer region of the building or of the skylight is designated with a reference numeral 8. The environmental conditions prevail in the outer region, with the room conditions prevailing in the room 7.

The plastic section 4 has a casement region 9 facing the room 7. The plastic section 4 further has a seat region 10 for receiving the edge region 11 of the pane 6. The interior of the plastic section 4 is divided into separate chambers by internal partitions. Generally, the plastic section has the following shape. A portion 12, which extends approximately perpendicular to the plane of the pane 6, passes into a portion 14, which extends at an angle to the pane 6, with the region 14 forming with a further portion 15 of the plastic section 4 an obtuse angle. The transition region between the regions 12 and 14 is formed as a step 13. At a side thereof adjacent to the window frame 3, the plastic section 4 has a wall 16 provided with a plurality of bands extending to a strut 17 which extends across the pane 6 (its width). On the side 18 of the strut 17 adjacent to the pane 6, the plastic section 4 has a wall 19 which extends approximately perpendicular to the surface of the pane 6 and which passes into the seat region 10 forming an angle of about 90°. The portions 12 and 14 and, partially, the portion 15 form together the already mentioned casement region 9 which is subjected to room conditions of the room 7, i.e., it is subjected to the temperatures prevailing in the room 7.

Opposite to the portions 12 and 14, there is provided, in the interior of the plastic section 4, an interior partition 20. Another interior portion 21, which is more remote from the portions 12, 14 extends parallel to the partition 20. A further interior portion 22 is provided behind the partition 21. Two transverse walls 23 and 24 extend transverse to the partitions 21, 22, 23. The plastic section 4 is provided with other interior partitions and transverse walls, which are not described in detail as not being necessary for understanding of the invention. Generally, the plastic section walls form a plurality of chambers, which not only stiffen the plastic section 4 but also insure an adequate heat insulation.

The interior partition 20 forms a chamber 25 which defines a chamber 26 for receiving an insert 27 which is formed as a thermal bridge 28. The thermal bridge 28 is formed of a metal section which extends along the portions 12, 14, 15 and the seat region 10. A more detailed description of the plastic section 4 now follows.

In the seat region 10, a Z-shaped step is formed on the section 4. The Z-shaped step is formed by wall 30, which extends parallel to the plane of the pane 6 and which passes into a wall 31 extending transverse to the wall 30 and downward. The wall 31 passes, again at approximately right angle, into a wall 32 which adjoins the wall 19. A web 33 extends parallel to the wall 31 in a spaced relationship thereto. The web 33 has, at an end thereof, a catch formation. Such a catch formation is also provided in the wall 31. Thereby, between the wall 31 and the web 33, a receiving channel 34 for a sealing 35 is formed. The sealing 35 is formed as a flat packing, and it is located between the pane 6 and the plastic section 4 in the region of the seat region 10 of the plastic section 4.

The thermal bridge-forming insert 27 has a bent 36 extending parallel to the portion 15 of the plastic section 4 and, preferably, in abutting relationship therewith. The bent 36 passes into a portion 37, which extends parallel to the portion 14 of the plastic section 4 and likewise engages the wall of the plastic section 4. In the region of the step 13, the portion 37 of the insert 27 passes into an angled portion 38 which has a profile corresponding to that of the step 13. The angled portion 38 passes into a portion 41 extending parallel to the portion 12, preferably, in abutting relationship therewith. A portion 42 of the insert 27 has an approximately Z-shaped profile corresponding to the Z-shaped profile formed by the walls 30, 31 and 32 of the plastic section 4 and, preferably, follows the walls 30, 31, 32 in abutting relationship therewith.

A plurality of connection elements 43, which connects the wall 32 with the portion 40 of the insert 27, are arranged in the receiving channel 34 in a spaced relationship to each other. Preferably, the connection elements 43 are spaced from each other by the same distance. Advantageously, the connection elements 43 are formed as sheet metal screws 44 the heads of which located in the receiving channel 42 are arranged below the sealing 35. The sheet metal screws 44 are screwed into the preliminary formed holes in the connectable portions of the section 4 and the insert 27 so that, during screwing of the sheet metal screws 44 no chips are formed between the wall 32 of plastic section 4 and the portion 42 of the insert 27 which chips, otherwise, would have caused a formation of a gap between the wall 30 and the portion 42 which would have adversely affected heat transfer. Also, the use of screws with a special head is also contemplated. In this case, a hollow stem of the screw is provided, so that chips, which may be eventually formed, can penetrate into the stem hollow, insuring that the screw head would abut the wall 32.

In order for the insert 27, which is made as a sheet metal section, to be able to engage the walls of the plastic section, with a preload, the respective profile portions 27*a*, 27*b* of the insert are formed resiliently yieldable. By an appropriate tightening of the screws 44, which connect the insert 27 with the plastic section 4, an additional biasing force is applied to the respective portions of the insert 27, increasing the preload with which the insert portions 27*a*, 27*b* engage the respective walls of the plastic section 4. In addition, the section 27*a* can; be made tilted which would insure that the section 27*a*, upon being pulled toward the wall 32, would engage it with even greater preload.

The engagement of the insert section 27*a* with a wall 32 with a preload can also be achieved by appropriately shaping a web 32*a* of the plastic section so that the section 27*a* of the insert 27 relatively tightly engages the wall 32, providing for a certain preload.

Also, by an appropriate shaping of a knee portion 32*b* of the wall 32, a certain pressure can be applied to the insert 27 by the room-side wall.

Figure 1B:
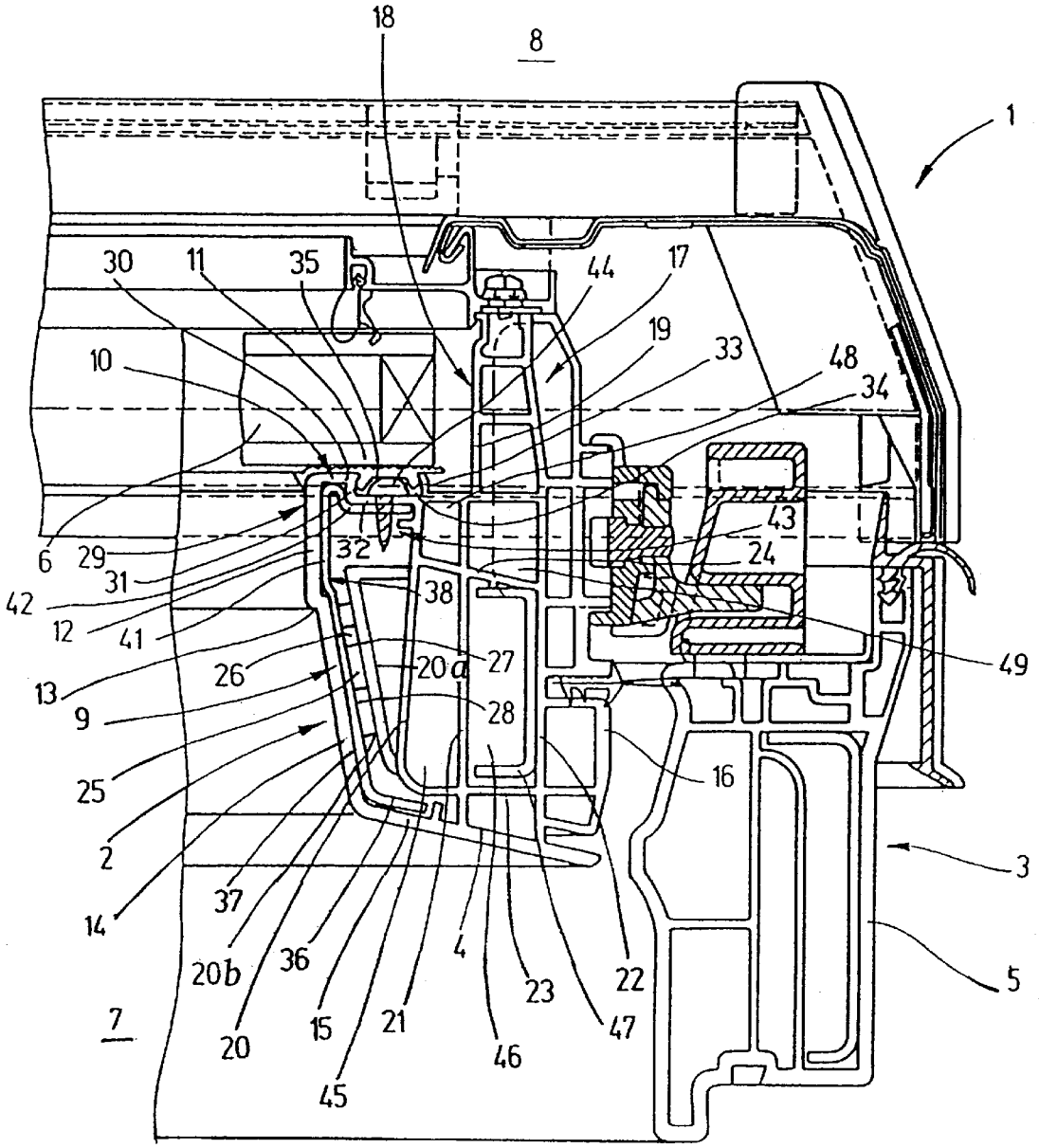
FIG. 1*b* is a view similar to that of FIG. 1*a* with another embodiment of a casement frame according to the present invention.

Another embodiment of a case frame according to the present invention in which the insert 27 engages the room-side wall with a preload is shown in FIG. 1*b*. In this embodiment, the plastic section 4 is provided with an additional partition 20*a*, and spacer elements 20*b* provided between the portions 20*a* and the insert 27 insure a pre-loaded engagement of the insert 27 with the room-side wall of the plastic section 4.

A chamber 45, which is formed between the interior partitions 20 and 21, forms a heat insulating chamber. Between the interior partitions 21 and 22, another chamber 46 is formed. A reinforcing section 47 is arranged in the chamber 46. Above the transverse wall 24 and above the chambers 45 and 46, there are provided additional thermo-insulating chambers 48 and 49.

The casement frame 2 of the skylight 1 according to the present invention functions as follows. The temperatures prevailing in the room 7 are higher than those in the outer region 8. As a result, the heat, which is generated in the room 7, is absorbed by the casement region 9 and is transferred further into the seat region 10 by the thermoconductive insert 27. In the seat region 10, the heat is transferred to the edge region 11 of the pane 6. The chambers 45, 46, 48, 49 and further chambers, e.g., formed in the strut 17, thermally isolate the room 7 from the outer region 8.

Figure 2:
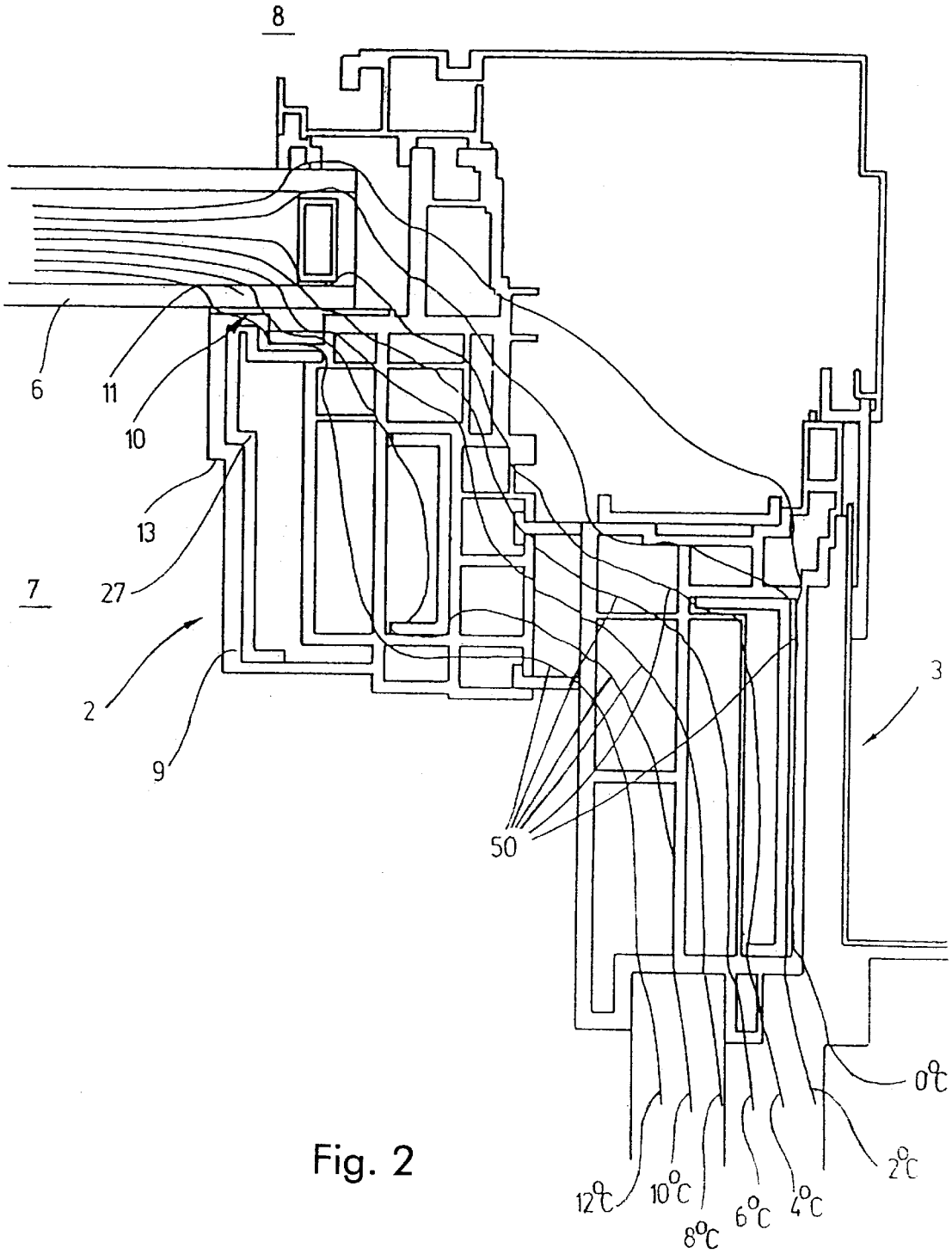
FIG. 2 is a view similar to that of FIG. 1 of another embodiment of a house skylight with drawn isotherms.

FIG. 2 clarifies the functioning of the casement frame according to the present invention. In FIG. 2, the casement frame 2 and the window frame 3 are formed differently but function in the same way as the respective frames 2 and 3 in the embodiment of FIG. 1, as here also an insert 27 is associated with the casement region 9 and transfers heat to the seat region 10 where the heat is transferred to the edge region 11 of the pane 6.

Let's assume that the temperature in the room 7 is 20° C., and that in the outer region 8 is −15° C. The isotherms 50 would then define temperatures, respectively, of 0°, 2°, 4°, 6°, 8°, 10° and 12° C. It can be seen that the isotherms in the transition region between the casement frame 2 and the pane 6 are so arranged that the 12° C. isotherm remains within the plastic section 4, and does not exit the room 7, bridging the room air, then entering the pane 6. The course of the isotherms, which is achieved with the casement frame according to the present invention, insures that no condensate is deposited on the inner surface of the pane 6 and on the outer surfaces of the plastic section 4. The inventive casement frame also insures that no condensate is formed in the region of the isolating vitrification, as it has place in the conventional construction of the skylight constructions, because the heat is transferred to the edge region of the pane. This is achieved by providing, according to the invention, a thermal bridge which, on one hand, reinforces the casement frame and, on the other hand, insures transfer of heat to the pane edge region.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A casement frame for a window, wherein the window includes a pane having a peripheral edge and an edge region in from the edge; the pane having a room facing side facing into the room, an opposite outward facing side; the casement frame comprising:

a hollow, plastic material section having a length dimension for extending around the peripheral edge of the window; the hollow section including:

an interior, divided into a plurality of chambers, and an exterior;

a seat region shaped for receiving the edge region of the window pane, the seat region including a wall that extends along the room facing side of the pane at the edge region of the pane to enable heat transfer between the wall and the edge region of the window pane; and a casement region extending away from the wall and away from the room facing side of the pane into the room; and at least one insert of heat conducting material extending along an interior surface of the casement region and extending to and along an interior surface of the wall of the seat region; the interior surface of the wall and of the casement region each having a surface profile and the insert having a profile substantially following the surface profiles along the room side of the wall and the interior of the casement region, such that the insert forms a thermal bridge between the casement region and the wall of the seat region for conducting room heat to the edge of the window pane;

wherein the casement region is updated to conduct heat between a room surface thereof to the insert, and the wall is adapted to conduct heat between the exterior surface thereof and the insert.

2. A casement frame as set forth in claim 1 wherein one of the plurality of chambers adjoins at least one other chamber of the plurality of chambers which forms a heat insulating chamber.

3. A casement frame as set forth in claim 1, wherein the insert is formed as a reinforcing insert.

4. The casement frame of claim 1, further comprising a connection between the insert and the hollow section for holding and positioning the insert to the interior of the hollow section.

5. A casement frame as set forth in claim 4, wherein the connection comprises a screw, the screw preloading engagement of the insert with the interior of the casement region and the wall of the seat region.

6. A casement frame as set forth in claim 4, wherein the connection forms an additional thermal bridge.

7. A casement frame as set forth in claim 1, wherein the plastic section includes a sealing provided in the seat region thereof for separating the edge region of the window pane from the seat region.

8. A casement frame as set forth in claim 7, wherein the sealing comprises flat packing.

9. A casement frame as set forth in claim 8, further comprising connection elements for connecting the insert with a respective wall of the plastic section and located below the sealing.

10. The casement frame of claim 1, further comprising means for pre-loading engagement of the insert with the inside surface of the room side panel and the pane side panel of the hollow section.

11. The casement frame of claim 1, wherein the heat conducting insert is comprised of metal.

12. The casement frame of claim 1, further comprising a sealing provided in the seat region of the hollow section for separating the edge region of the window pane from the seat region of the hollow section, the sealing being adapted for heat transmission between the pane side panel of the hollow section and the edge region of the window pane.

13. The casement frame of claim 1, further comprising chamber defining panels within the hollow section defining the plurality of chambers in the hollow section, each of the chambers extending along the length of the hollow section, the chamber defining panels being so placed as to define one of the chambers to be of a shape such that the heat conducting insert is within the one chamber and such that the one chamber is thermally isolated from others of the chambers in the hollow section.

14. The casement frame of claim 1, further comprising the heat conducting insert being pre-loaded for contacting the inside surface of the room side panel and the pane side panel of the hollow section.

* * * * *